US006523506B2

(12) United States Patent
Hirano et al.

(10) Patent No.: US 6,523,506 B2
(45) Date of Patent: Feb. 25, 2003

(54) WATER-COOLED V-TYPE ENGINE WITH TWO CYLINDERS

(75) Inventors: Michio Hirano, Akashi (JP); Takemi Inoue, Kakogawa (JP); Tetsuaki Shirai, Kobe (JP); Yukio Miki, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/940,800

(22) Filed: Aug. 29, 2001

(65) Prior Publication Data

US 2002/0023596 A1 Feb. 28, 2002

(30) Foreign Application Priority Data

Aug. 31, 2000 (JP) ..... 2000-262880

(51) Int. Cl.[7] ..... F01P 7/14
(52) U.S. Cl. ..... 123/41.1
(58) Field of Search ..... 123/41.1, 41.14

(56) References Cited

U.S. PATENT DOCUMENTS 4,960,081 A * 10/1990 Atsuumi ..... 123/41.31

FOREIGN PATENT DOCUMENTS

JP 63-12626 U 1/1988
JP 1-125516 A * 5/1989 ..... 123/41.1

* cited by examiner

*Primary Examiner*—Gene Mancene
*Assistant Examiner*—Hyder Ali
(74) *Attorney, Agent, or Firm*—Oliff & Berridge, PLC

(57) ABSTRACT

A water-cooled V-type engine includes: a crankcase in which a crankshaft is rotatably disposed; two cylinders disposed on the crankcase so as to form V-shape; a starter disposed below one of the two cylinders; and a cooling system for cooling the engine with a cooling water. The cooling system includes: a radiator for cooling the cooling water; water jackets disposed on the two cylinders; and a thermostat disposed in a supply line having one end connected to a water outlet formed in a lower end part of the radiator and the other end connected to inlets of the water jackets. The thermostat is disposed below the other of the two cylinders. The engine can be formed in compact construction and the piping of the cooling system can be simplified since the starter and the thermostat are disposed below the tilted cylinders, respectively.

8 Claims, 4 Drawing Sheets

WATER-COOLED V-TYPE ENGINE WITH TWO CYLINDERS

BACKGROUND OF THE INVENTION

1. Field of the Invention

The present invention relates to a water-cooled V-type engine with two cylinders, and particularly to the piping and cooling devices of a cooling system included in the engine.

2. Description of the Related Art

In a water-cooling system of a water-cooled V-type engine with two cylinders, a thermostat valve is disposed generally at the outlet of a water jacket formed in the cylinder head of a cylinder so as to protrude from one side of the cylinder. The thermostat valve measures the temperature of cooling water at the outlet of the water jacket during a warm-up or during a normal operation. The thermostat valve opens when the temperature of the cooling water is higher than a predetermined temperature to return the cooling water discharged through the outlet of the water jacket to a radiator and to supply the cooled cooling water flowed through the radiator to the water jacket of the cylinder.

In the water-cooling system including the thermostat valve disposed at the outlet of the water jacket, especially in warm-up operation, the thermostat valve opens upon the increase of the temperature of the cooling water to the predetermined temperature and the cooled cooling water flowed through the radiator flows suddenly into the water jacket. Consequently, the cylinder is cooled suddenly and the temperature of the cooling water is apt to hunt. Particularly in a state where the atmospheric temperature is low or a cooling fan is continuously rotating, the temperature of the cooling water hunts in a very wide temperature range.

On the other hand, as shown in FIG. 5, a water-cooling system with a thermostat valve disposed at the inlet of a water jacket, so called "an inlet thermostat type water-cooling system", is disclosed in Japanese Utility Model Publication No. Sho 63-12626. In this system, the thermostat valve 110 is placed in a water supply pipe 105 having one end connected to a water outlet 103 formed at a lower end part of a radiator 102 and the other end connected to the water inlet 107 of a water jacket 106.

When the thermostat valve 110 is thus placed in the cooling water supply pipe 105, the thermostat valve 110 operates according to the temperature of the cooling water discharged from the water jacket 106 and flowed through a bypass passage 108, to mix the cooling water of a low temperature supplied from the radiator 102 and the cooling water of a high temperature discharged from the water jacket 106 and flowed through the bypass passage 108. Accordingly, the mixed cooling water of a substantially fixed temperature flows into the water jacket 106. Thus the sudden variation of the temperature of the cylinder can be avoided and the hunting of the temperature of the cooling water can be prevented.

However, in the inlet thermostat type water-cooling system shown in FIG. 5, when the cooling water is supplied to the water-cooling system through a filler opening 112 formed in the radiator 102, the cooling water is unable to flow past the thermostat valve 110 into the water jacket 106. Therefore, an auxiliary filler opening 120 must be formed in an upper end part of the water jacket 106 and the cooling water must be supplied through the auxiliary filler opening 120 into the water jacket 106, which requires additional work.

Moreover, when draining the cooling water from the water-cooling system, all the cooling water cannot be drained through a drain port 113 formed in the radiator 102. Accordingly, the cooling water must be drained also through a secondary drain port 121 formed in a lower end part of the water jacket 106.

SUMMARY OF THE INVENTION

Accordingly, it is an object of the present invention to provide a water-cooled V-type engine with two cylinders including a cooling system capable of stabilizing the temperature of the cooling water to prevent the hunting of cooling water, of enabling forming the engine in compact construction and of facilitating work for supplying cooling water to the cooling system and for draining the cooling water from the cooling system.

According to a first aspect of the present invention, a water-cooled V-type engine includes: a crankcase in which a crankshaft is rotatably disposed; two cylinders disposed on the crankcase so as to form V-shape; a starter disposed below one of the two cylinders; and a cooling system for cooling the engine with a cooling water. The cooling system includes: a radiator for cooling the cooling water; water jackets disposed on the two cylinders; and a thermostat disposed in a supply line having one end connected to a water outlet formed in a lower end part of the radiator and the other end connected to inlets of the water jackets. The thermostat is disposed below the other of the two cylinders.

Since the thermostat is disposed at the side of the inlet of the water jacket, the temperature of the cooling water can be stabilized and the hunting of the temperature of the cooling water can be prevented, moreover, since the starter and the thermostat are disposed below the tilted cylinders, respectively, the engine can be formed in compact construction and the piping of the cooling system can be simplified.

Preferably, the water-cooled V-type engine with two cylinders according to the first aspect of the present invention further includes a water pump disposed in the supply line for forcing the cooling water. The radiator is disposed on one side of the engine with respect to an axial direction of the crankshaft. The water pump is disposed on the other side of the engine with respect to the axial direction of the crankshaft. The thermostat is disposed in the supply line between the radiator and the water pump.

Thus the piping of the cooling system can be simplified.

Preferably, in the water-cooled V-type engine with two cylinders according to the first aspect of the present invention, the thermostat is disposed so that a center of the thermostat is located in a width range corresponding to an axial dimension of the cylinder.

Preferably, the water-cooled V-type engine with two cylinders according to the first aspect of the present invention further includes: a bypass line adapted to supply the cooling water to the water jackets and drain the cooling water from the water jackets, the bypass line connecting lower end parts of the water jackets with a lowermost part of the supply line between the water outlet of the radiator and the thermostat, and a check valve for preventing a reverse flow of the cooling water from the water jackets to the supply line.

Thus both the radiator and the water jackets can be simultaneously filled up with the cooling water simply by pouring the cooling water through a filler opening of the radiator into the radiator and the cooling water can be efficiently supplied to the cooling system.

Preferably, in the water-cooled V-type engine with two cylinders according to the first aspect of the present invention, a drain port capable of being opened and closed is formed in a lowermost part of the bypass line.

Thus, both the radiator and the water jackets can be simultaneously drained only through the single drain port to achieve draining work efficiently.

According to a second aspect of the present invention, a water-cooled V-type engine includes: a crankcase in which a crankshaft is rotatably disposed; two cylinders disposed on the crankcase so as to form V-shape; a cooling system for cooling the engine with a cooling water. The cooling system includes a radiator for cooling the cooling water, water jackets disposed on the two cylinders, and a thermostat disposed in a supply line having one end connected to a water outlet formed in a lower end part of the radiator and the other end connected to inlets of the water jackets. The engine further includes: a bypass line adapted to supply the cooling water to the water jackets and drain the cooling water from the water jackets, the bypass line connecting lower end parts of the water jackets with a lowermost part of the supply line between the water outlet of the radiator and the thermostat; and a check valve for preventing a reverse flow of the cooling water from the water jackets to the supply line.

Thus both the radiator and the water jackets can be simultaneously filled up with the cooling water simply by pouring the cooling water through a filler opening of the radiator into the radiator and the cooling water can be efficiently supplied to the cooling system.

Preferably, in the water-cooled V-type engine with two cylinders according to the second aspect of the present invention, a drain port capable of being opened and closed is formed in a lowermost part of the bypass line.

Thus, both the radiator and the water jackets can be simultaneously drained only through the single drain port to achieve draining work efficiently.

BRIEF DESCRIPTION OF THE DRAWINGS

The above and other objects, features and advantages of the present invention will become more apparent form the following description taken in connection with the accompanying drawings, in which.

DESCRIPTION OF THE PREFERRED EMBODIMENTS

Figure 1:
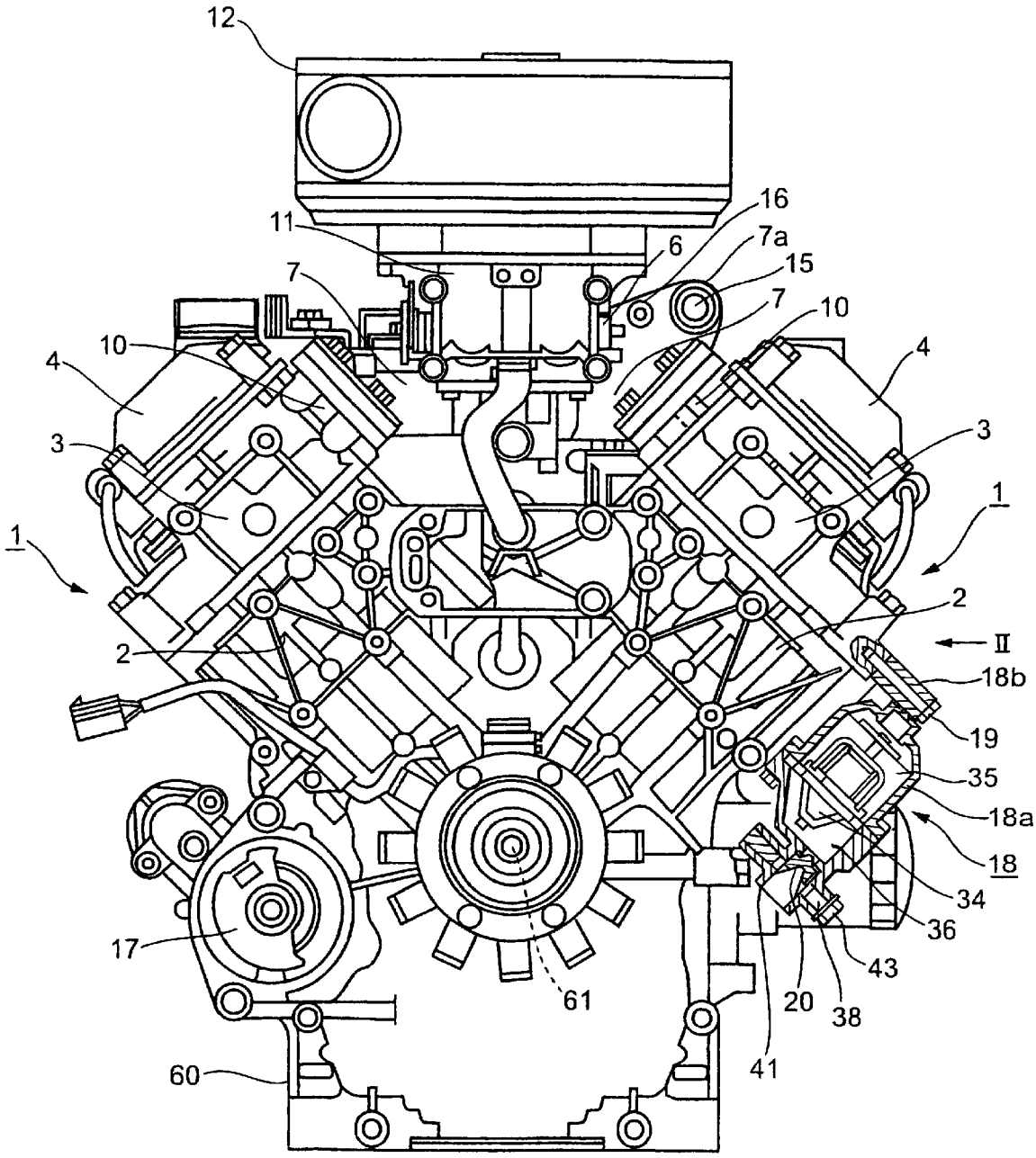
FIG. 1 is a front elevation of a water-cooled two-cylinder V-type engine in a preferred embodiment according to the present invention, in which a radiator is removed.

Referring to FIG. 1, a water-cooled two-cylinder V-type engine in a preferred embodiment according to the present invention has two cylinders 1 disposed on a crankcase 60 so as to form V-shape. A crankshaft 61 is rotatably mounted in the crankcase 60. Each cylinder 1 includes a cylinder block 2, a cylinder head 3 and a cylinder head cover 4. A carburetor 6 and a bifurcate intake manifold 7 are disposed in a space between the two cylinders 1. The intake manifold 7 has opposite ends connected to intake ports 10 formed in the cylinder head 3, respectively. An inlet formed in a middle part of the intake manifold 7 is connected to the carburetor 6. An inlet of the carburetor 6 is connected to an air cleaner 12 disposed above the carburetor 6 by a connecting pipe 11. The intake manifold 7 serves also as a cooling water collecting pipe. The intake manifold 7 is provided with a cooling water passage formed along an intake air passage. The intake manifold 7 has a protruding part 7*a* provided with a return outlet 15 and a bypass outlet 16.

A starter 17 is disposed below one of the cylinder blocks 2, and a thermostat 18 integrally provided with a check valve 20 is disposed below the other cylinder block 2. The thermostat 18 includes a valve case 18*a* and a thermostat valve 34. The thermostat 18 is set in an inclined position with its axis extended substantially in parallel to the axis of the cylinder block 2. The valve case 18*a* is provided with a mounting flange 18*b* fastened to the cylinder head 3 with bolts 19. The interior of the valve case 18*a* of the thermostat 18 is divided into an upper chamber 35 and a lower chamber 36 by the thermostat valve 34 having a partition wall provided with an opening. The thermostat valve 34 opens and closes the opening of the partition wall thereof. A check valve case 41 and a drain port 38 are formed in a bottom part of the valve case 18*a* corresponding to a bottom part of the lower chamber 36. A threaded drain plug 43 closes the drain port 38.

Figure 2:
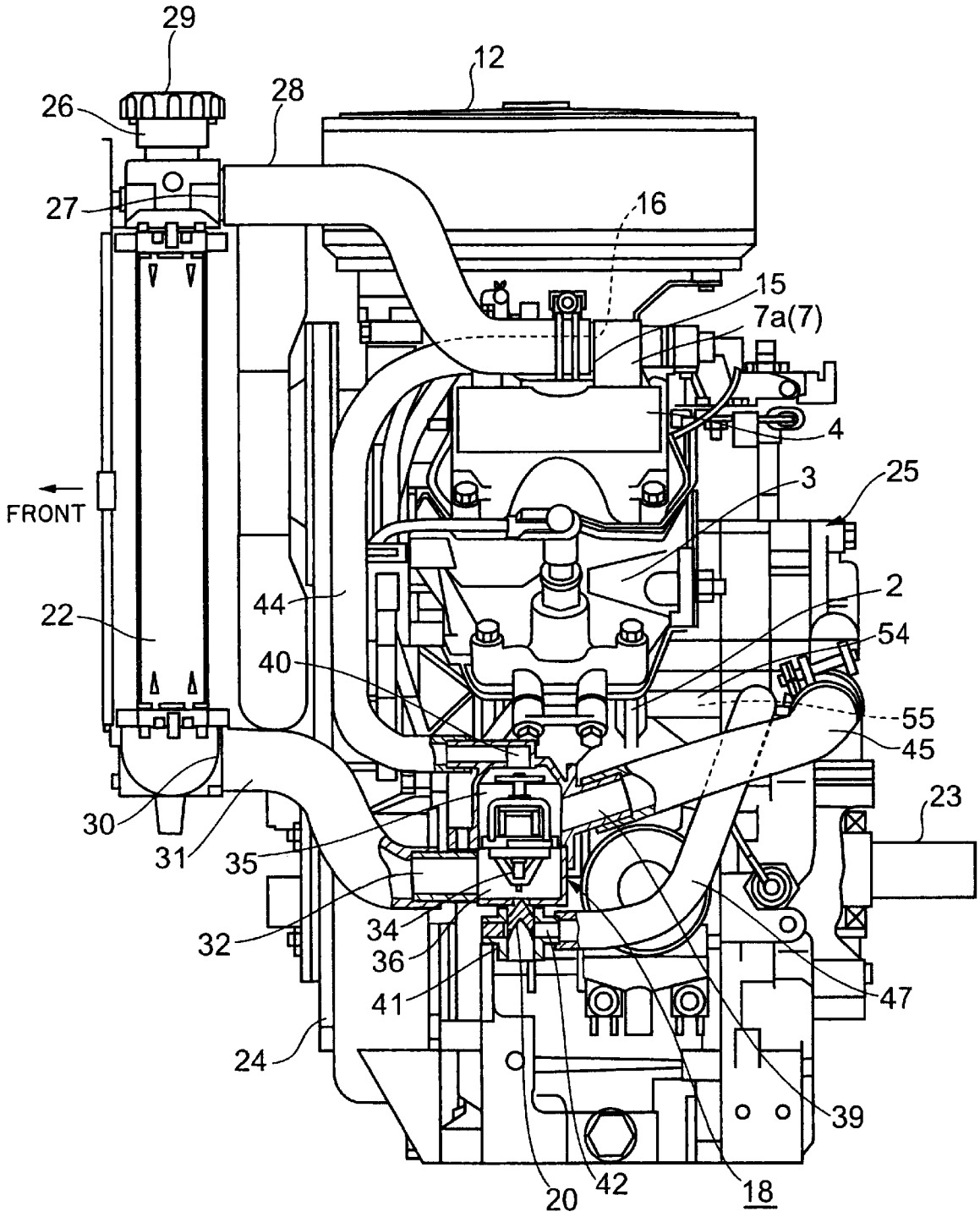
FIG. 2 is a side elevation of the water-cooled two-cylinder V-type engine shown in FIG. 1, taken in the direction of the arrow II in FIG. 1.

Referring to FIG. 2, a radiator 22 is disposed on the front side of the engine on which a flywheel 24 is supported on the front end of the engine. A water pump 25 is disposed on the rear side of the engine from which an output shaft 23 projects rearward. The thermostat 18 is disposed so that at least its center is located in a width range corresponding to the axial dimension of the cylinder blocks 2.

A water filler opening 26 is formed in the upper wall of the radiator 22 and is closed by a filler cap 29. A cooling water inlet 27 is formed in an upper end part of the rear surface of the radiator 22. A return hose 28 connects the cooling water inlet 27 with the return outlet 15 of the intake manifold 7. A cooling water outlet 30 is formed in a lower end part of the rear surface of the radiator 22. A first cooling water supply hose 31 connects the cooling water outlet 30 with the inlet 32 of the thermostat 18.

An outlet 39 and a bypass inlet 40 are formed in a part of the valve case 18*a* of the thermostat 18, forming the upper chamber 35. The inlet 32 is formed in a part of the valve case 18*a* of the thermostat 18, forming the lower chamber 36. The check valve case 41 is provided with a bypass opening 42 for supplying and draining the cooling water.

A bypass pipe 44 connects the bypass inlet 40 of the valve case 18*a* with the bypass outlet 16 of the intake manifold 7. A second cooling water supply hose 45 connects the outlet 39 of the valve case 18*a* with the suction port of the water pump 25. A draining bypass pipe 47 connects the bypass opening 42 with bottom openings 55 formed in bottom parts of the water jackets 54 of the cylinder blocks 2.

Figure 4:
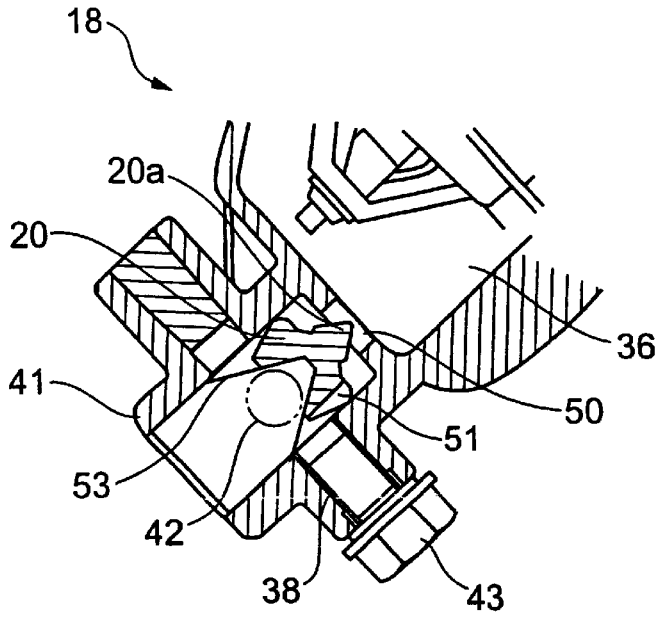
FIG. 4 is an enlarged sectional view of check valve portion.
Figure 5:
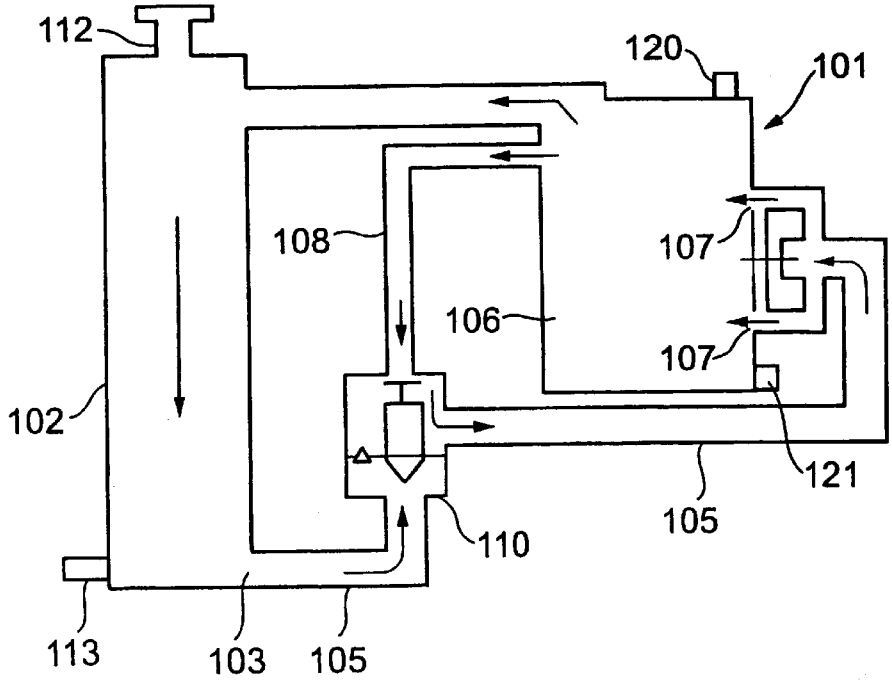
FIG.5 PRIOR ART
FIG. 5 is a diagrammatic view of a water-cooling system included in a conventional water-cooled two-cylinder V-type engine.

Referring to FIG. 4 showing the check valve portion in an enlarged sectional view, the check valve 20 has an upper conical part 20*a* extending into a valve hole 50 and provided with a plurality of grooves 51. When the engine is stopped, the check valve 20 rests on a conical stopper 53 as shown in FIG. 4, the valve opening 50 is opened, so that the cooling water can flow from the lower chamber 36 through the grooves 51 toward the bypass opening 42. When the pressure in the bypass opening 42 is high, the check valve 20 is pushed up to close the valve opening 50 to stop the flow of the cooling water from the bypass opening 42 into the lower chamber 36. The drain port 38 is formed in the lowermost part of the check valve case 41 so as to open obliquely downward.

Figure 3:
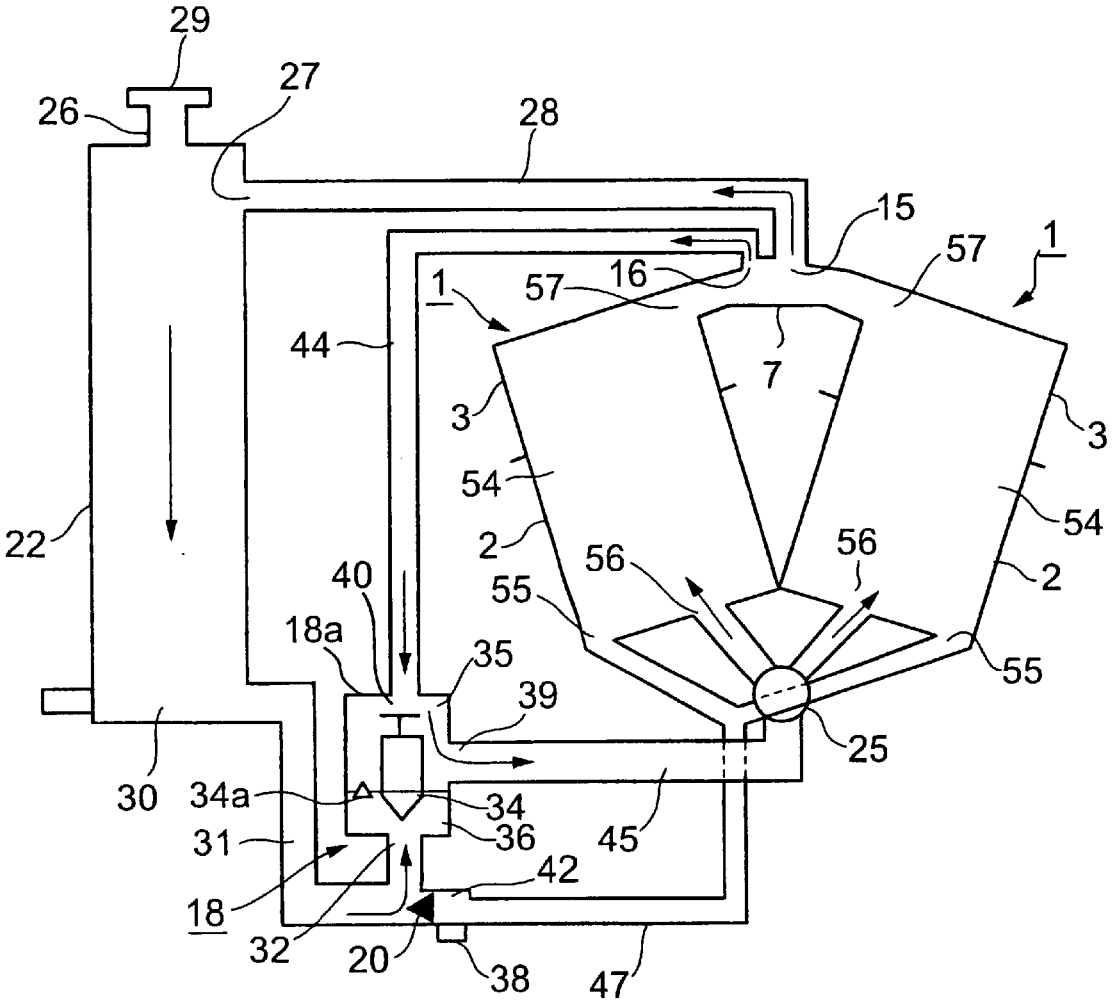
FIG. 3 is diagrammatic view of a water-cooling system included in the water-cooled two-cylinder V-type engine shown in FIG. 1.

Referring to FIG. 3 diagrammatically showing the water-cooling system of the present embodiment having the thermostat 18 disposed at the inlet side of the water jackets 54, the drain port 38 is on the side of the water jackets 54 with respect to the check valve 20 at the lowermost part of the cooling water passage between the outlet 30 of the radiator 22 and the bottom openings 55 of the water jackets. The discharge port of the water pump 25 is connected to the inlets 56 of the water jackets 54 of the cylinder blocks 2.

The thermostat valve 34 closes the opening of the partition wall thereof dividing the interior of the valve case 18*a* of the thermostat 18 into the upper chamber 35 and the lower chamber 36 when the temperature of the cooling water flowing through the thermostat 18 is lower than a set temperature. Consequently, the cooling water flows through the bypass inlet 40 into the upper chamber 35 and flows out of the upper chamber 35 through the outlet 39. When the temperature of the cooling water is not lower than the set temperature, the thermostat valve 34 opens the opening of the partition wall thereof dividing the interior of the valve case 18*a* of the thermostat 18 into the upper chamber 35 and the lower chamber 36. Consequently, the cooling water flowed through the inlet 32 into the upper chamber 35 and the cooling water flowed through the bypass inlet 40 into the upper chamber 35 are mixed. The mixed cooling water flows through the outlet 39 and the water pump 25 into the water jackets 54 of the cylinder blocks 2. A check valve 34*a* is placed in the partition wall separating the upper chamber 35 and the lower chamber 36 of the valve case 18*a* from each other.

When supplying the cooling water into the water-cooling system shown in FIG. 3 for the first time after the completion of manufacturing the water-cooled two-cylinder V-type engine, the filler cap 29 is removed and the cooling water is poured into the radiator 22 through the filler opening 26. Then the cooling water flows from the radiator 22 through the first cooling water supply hose 31, the check valve 20, the bypass pipe 47 and the bottom openings 55 into the water jackets 54 of the cylinder blocks 2. Thus both the radiator 22 and the water jackets 54 can be simultaneously and quickly filled up with the cooling water.

During a warm-up, the opening in the partition wall of the thermostat valve 34 is closed while the temperature of the cooling water flowing through the upper chamber 35 of the thermostat 18 is lower than the set temperature. Consequently, the cooling water discharged through the outlets 57 of the water jackets 54 of the cylinder heads 3 flows through the return bypass pipe 44, the upper chamber 35 of the thermostat 18 and the second cooling water supply hose 45 into the water pump 25. Then the water pump 25 pumps the cooling water into the water jackets 54 of the cylinder blocks 2 through the inlets 56. Although the interior of the bypass pipe 47 is pressurized by pressure produced by the water pump 25 while the engine is in the normal operation, the check valve 20 prevents the reverse flow of the cooling water into the thermostat 18.

The thermostat valve 34 of the thermostat 18 opens the opening between the chambers 35 and 36 when the temperature of the cooling water flowing through the upper chamber 35 of the thermostat 18 increases beyond the set temperature. Consequently, the cool cooling water cooled by the radiator 22 and the hot cooling water returned through the return bypass pipe 44 are mixed in the thermostat 18. Then, the water pump 25 sucks the mixed cooling water through the second cooling water supply hose 45 and pumps the same into the water jackets 54.

When draining the cooling water from the cooling system for maintenance work, the drain port 38 is opened. Since the drain port 38 is at the lowermost part of the cooling water passage including the first cooling water supply hose 31 and the bypass pipe 47, and extending between the outlet 30 of the radiator 22 and the bottom openings 55 of the water jackets 54, the cooling water contained in the water jackets 54 is drained through the bypass pipe 47 and the drain port 38. Then, the cooling water contained in the radiator 22 is drained through the first cooling water supply hose 31, the check valve 20 and the drain port 38. The cooling water staying in the return bypass pipe 44, the second cooling water supply hose 45 and the upper chamber 35 of the valve case 18*a* is drained through the check valve 34*a* of the thermostat valve 34, the inlet 32 of the thermostat 18 and the check valve 20 and the drain port 38.

As shown in FIG. 2, in the water-cooling system having the thermostat 18 disposed at the inlet side of the water jackets 54, the thermostat 18 is disposed between the radiator 22 and the water pump 25 on the inlet side of the water jackets 54. Therefore, the first cooling water supply hose 31 extended between the cooling water outlet 30 of the radiator 22 and the thermostat 18 and the second cooling water supply hose 45 extended between the thermostat 18 and the water pump 25 can be short and can be properly arranged in a space around a lower part of the engine. The bypass pipe 47 can be extended neatly in a space around the lower part of the cylinder blocks 2.

The valve case of the check valve 20 and the valve case 18*a* of the thermostat 18 may be formed separately. The valve case 18*a* of the thermostat 18 may be formed integrally with the cylinder block 2.

As apparent from the forgoing description, the water cooled V-type engine with two cylinders of the present invention has the following advantageous effects.

The temperature of the cooling water is stable, particularly during a warm-up operation, and the hunting of the temperature of the cooling water can be prevented.

Since the starter 17 is disposed below one of the cylinders 1 and the thermostat 18 is disposed below the other cylinder 1, space around the water-cooled two-cylinder V-type engine can be effectively utilized and the water-cooled two-cylinder V-type engine has compact construction.

Since the thermostat 18 is disposed below one of the cylinders 1, the first cooling water supply hose 31 extended between the cooling water outlet 30 of the radiator 22 and the thermostat 18 and the second cooling water supply hose 45 extended between the thermostat 18 and the water pump 25 can be short and be properly arranged in a space around a lower part of the water-cooled two-cylinder V-type engine, and the cooling water flows smoothly during the operation of the water-cooled two-cylinder V-type engine.

Since the radiator 22 is disposed on the front side of the engine, the water pump 25 is disposed on the rear side of the engine, and the thermostat 18 is placed in the line connecting the radiator 22 with the water pump 25, the piping connecting the radiator 22, the thermostat 18 and the water pump can be simplified.

Since the thermostat 18 is disposed so that the center thereof is located in a width range corresponding to the axial dimension of the cylinder 1, the water-cooled two-cylinder V-type engine can be formed in a small axial dimension.

Since the thermostat 18 is placed in the line extending between the outlet 30 of the radiator 22 and the inlets 56 of the water jackets 54 of the cylinders 1, the lower ends 55 of the water jackets 54 and the lowermost part of the line connecting the outlet 30 of the radiator 22 and the thermostat 18 are connected by the bypass pipe 47, and the check valve 20 for preventing the reverse flow of the cooling water from the water jackets 54 is placed in the bypass pipe 47, the radiator 22 and the water jackets 54 can be simultaneously filled up with the cooling water by pouring the cooling water through the filler opening 26 into the radiator 22. Thus cooling water supply work can be efficiently and properly achieved.

Since the drain port 38 is placed at the lowermost part of the bypass pipe 47, the cooling water contained in the radiator 22 and the cooling water contained in the water jackets 54 can be simultaneously and completely drained through the drain port 38. Thus work for draining the cooling water from the water-cooling system can be efficiently carried out.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A water-cooled V-type engine, comprising:

a crankcase in which a crankshaft is rotatably disposed;

first and second cylinders disposed on said crankcase so as to form V-shape;

a starter disposed below said first cylinder; and a cooling system for cooling said engine with a cooling water, said cooling system including:

a radiator for cooling said cooling water;

water jackets disposed on said first and second cylinders;

a thermostat disposed in a supply line having one end connected to a water outlet formed in a lower end part of said radiator and the other end connected to inlets of said water jackets, said thermostat being disposed below said second cylinder; and a water pump disposed in said supply line for forcing said cooling water, wherein said radiator is disposed on one side of said engine with respect to an axial direction of said crankshaft, wherein said water pump is disposed on the other side of said engine with respect to said axial direction of said crankshaft, and wherein said thermostat is disposed in said supply line between said radiator and said water pump.

2. A water-cooled V-type engine according to claim 1, wherein said thermostat is disposed so that a center of said thermostat is located in a width range corresponding to an axial dimension of said second cylinder.

3. A water-cooled V-type engine according to claim 1, further comprising:

a bypass line adapted to supply said cooling water to said water jackets and drain said cooling water from said water jackets, said bypass line connecting lower end parts of said water jackets with a lowermost part of said supply line between said water outlet of said radiator and said thermostat, and a check valve for preventing a reverse flow of said cooling water from said water jackets to said supply line.

4. A water-cooled V-type engine according to claim 3, wherein a drain port capable of being opened and closed is formed in a lowermost part of said bypass line.

5. A water-cooled V-type engine comprising:

a crankcase in which a crankshaft is rotatably disposed;

two cylinders disposed on said crankcase so as to form V-shape;

a cooling system for cooling said engine with a cooling water, said cooling system including a radiator for cooling said cooling water, water jackets disposed on said two cylinders, and a thermostat disposed in a supply line having one end connected to a water outlet formed in a lower end part of said radiator and the other end connected to inlets of said water jackets;

a bypass line adapted to supply said cooling water to said water jackets and drain said cooling water from said water jackets, said bypass line connecting lower end parts of said water jackets with a lowermost part of said supply line between said water outlet of said radiator and said thermostat; and a check valve for preventing a reverse flow of said cooling water from said water jackets to said supply line.

6. A water-cooled V-type engine according to claim 5, wherein a drain port capable of being opened and closed is formed in a lowermost part of said bypass line.

7. A water-cooled V-type engine, comprising:

a crankcase in which a crankshaft is rotatably disposed;

two cylinders disposed on said crankcase so as to form V-shape;

a starter disposed below one of said two cylinders; and a cooling system for cooling said engine with a cooling water, said cooling system including:

a radiator for cooling said cooling water;

water jackets disposed on said two cylinders;

a thermostat disposed in a supply line having one end connected to a water outlet formed in a lower end part of said radiator and the other end connected to inlets of said water jackets, said thermostat being disposed below the other of said two cylinders;

a bypass line adapted to supply said cooling water to said water jackets and drain said cooling water from said water jackets, said bypass line connecting lower end parts of said water jackets with a lowermost part of said supply line between said water outlet of said radiator and said thermostat, and a check valve for preventing a reverse flow of said cooling water from said water jackets to said supply line.

8. A water-cooled V-type engine according to claim 7, wherein a drain port capable of being opened and closed is formed in a lowermost part of said bypass line.

* * * * *